US007003927B2

(12) United States Patent
Yang

(10) Patent No.: US 7,003,927 B2
(45) Date of Patent: Feb. 28, 2006

(54) APPARATUS FOR TIGHTENING AND LOOSENING CAPS ON CONTAINERS

(75) Inventor: Sheng-Hui Yang, Taichung (TW)

(73) Assignee: CVC Technologies, Inc., Tai-Li (TW)

( * ) Notice: Subject to any disclaimer, the term of this patent is extended or adjusted under 35 U.S.C. 154(b) by 0 days.

(21) Appl. No.: 10/816,324

(22) Filed: Mar. 31, 2004

(65) Prior Publication Data

US 2005/0144908 A1 Jul. 7, 2005

(51) Int. Cl.
*B65B 7/28* (2006.01)

(52) U.S. Cl. ..... 53/331.5; 53/317

(58) Field of Classification Search ..... 53/317, 53/331.5

See application file for complete search history.

(56) References Cited

U.S. PATENT DOCUMENTS 1,172,447 A * 2/1916 Forte ..... 53/331.5
1,435,739 A * 11/1922 Risser ..... 53/331.5
2,889,674 A * 6/1959 Hamilton et al. ..... 53/317
3,018,597 A * 1/1962 Hohl ..... 53/317
3,435,587 A * 4/1969 Weller ..... 53/317
5,918,442 A * 7/1999 Dewees et al. ..... 53/317

* cited by examiner

*Primary Examiner*—John Sipos
(74) *Attorney, Agent, or Firm*—Brinks Hofer Gilson & Lione

(57) ABSTRACT

An apparatus for tightening and loosening caps on containers includes a support, a rotary member mounted rotatably on the support and rotatable about a rotation axis, a complementary unit that is complementary to and that cooperates with the rotary member to define a cap passage therebetween, and a driving unit for driving the rotary member to rotate about the rotation axis. At least one of the rotary member and the complementary unit is pivotable relative to the support so as to permit passage of the cap through the cap passage.

6 Claims, 7 Drawing Sheets

APPARATUS FOR TIGHTENING AND LOOSENING CAPS ON CONTAINERS

BACKGROUND OF THE INVENTION

1. Field of the Invention

This invention relates to an apparatus for tightening and loosening caps on containers, more particularly to an apparatus having two opposite rotary members that are adapted to contact frictionally and slidingly caps on containers.

2. Description of the Related Art

FIG. 1 illustrates a conventional apparatus 1 for tightening and loosening a cap 21 on a container 22, such as a bottle. The cap 21 threadedly engages the container 22. The conventional apparatus 1 includes a connecting rod 16, a cap-connecting member 11 that is sleeved on the connecting rod 16 and that is adapted to be connected to the cap 21, a positioning inner sleeve 12 sleeved on the cap-connecting member 11, a connecting outer sleeve 14 sleeved on the positioning inner sleeve 12, a magnet 17 disposed between and connected magnetically to the connecting outer sleeve 14 and the positioning inner sleeve 12, and a rotary socket 15 connected to the connecting outer sleeve 14. In operation, the positioning inner sleeve 12 and the cap-connecting member 11 are driven to rotate through the magnet 17 upon rotation of the rotary socket 15. When the cap 21 is tightened on the container 22, and when the friction force between the cap 21 and the container 22 overcomes the magnetic attraction force between the magnet 17 and the positioning inner sleeve 12, the cap 21 can no longer rotate relative to the container 22 by the rotation of the rotary socket 15.

The conventional apparatus 1 is disadvantageous in that several sizes of the cap-connecting member 11 are required to be manufactured for corresponding sizes of the caps 21 and that it is laborious to replace the cap-connecting member 11 for a desired size of the cap 21. In addition, since the friction force between the cap 21 and the container 22 varies with the materials used for forming the cap 21 and the container 22, and since the magnetic attraction force between the positioning inner sleeve 12 and the magnet 17 is fixed and cannot be adjusted, the cap 21 may not be driven to a desired position on the container 22 when the aforesaid friction force is relatively large and exceeds the aforesaid magnetic attraction force.

SUMMARY OF THE INVENTION

Therefore, the object of the present invention is to provide an apparatus with a pair of rotary members that are capable of overcoming the aforesaid drawbacks of the prior art.

According to the present invention, there is provided an apparatus for tightening and loosening a cap on a container. The apparatus comprises: a support; a rotary member mounted rotatably on the support and rotatable about a rotation axis; a complementary unit that is mounted on the support and that is complementary to and that cooperates with the rotary member to define a cap passage therebetween, the cap passage having a width that is adapted to be configured so as to be slightly smaller than the diameter of the cap in order to permit frictional and sliding contact between the rotary member and the cap and between the complementary unit and the cap; and a driving unit for driving the rotary member to rotate about the rotation axis. At least one of the rotary member and the complementary unit is pivotable relative to the support in such a manner so as to permit widening of the cap passage when the cap is pushed through the cap passage by an external force.

BRIEF DESCRIPTION OF THE DRAWINGS

In drawings which illustrate an embodiment of the invention.

DETAILED DESCRIPTION OF THE PREFERRED EMBODIMENT

Figure 1:
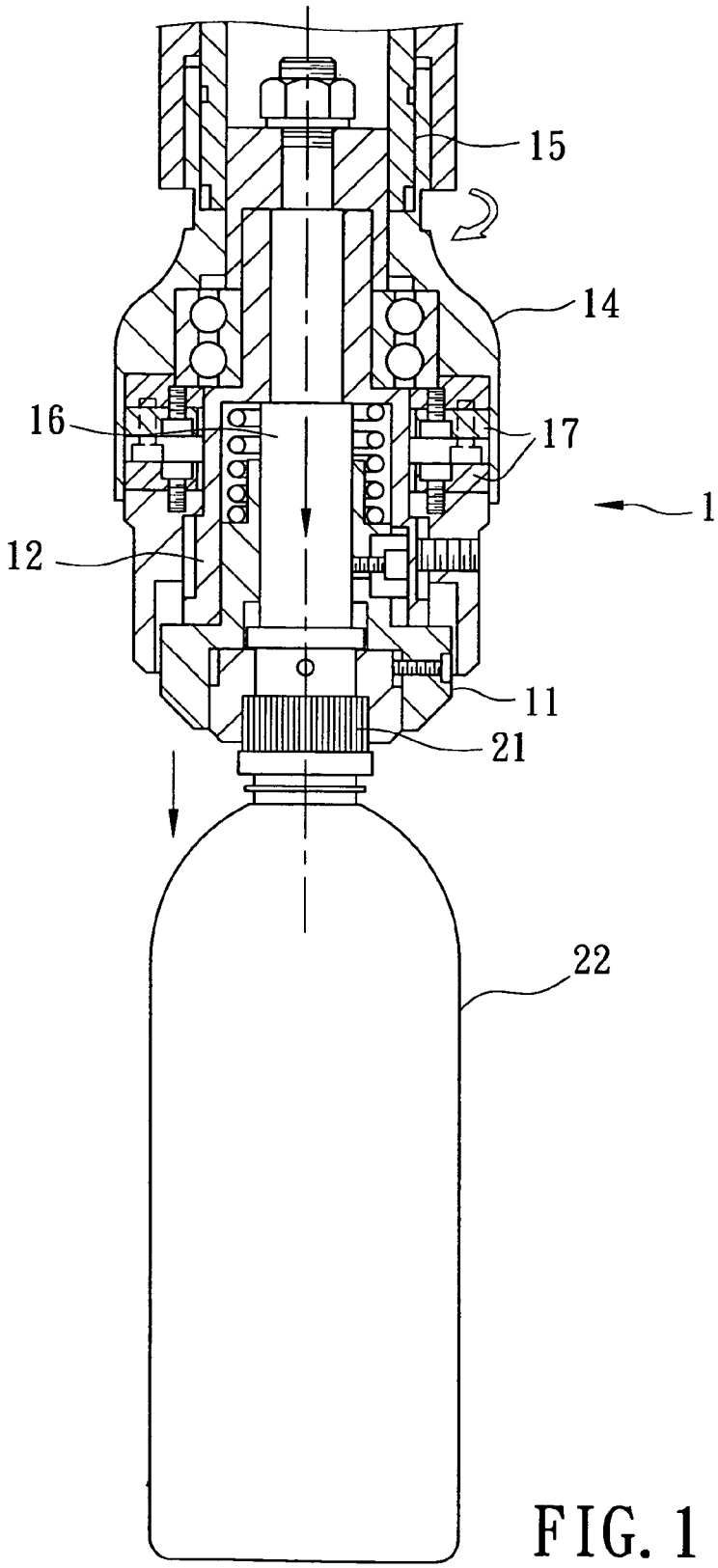
FIG. 1 PRIOR ART
FIG. 1 is a sectional view of a conventional apparatus for tightening and loosening a cap on a container.
Figure 2:
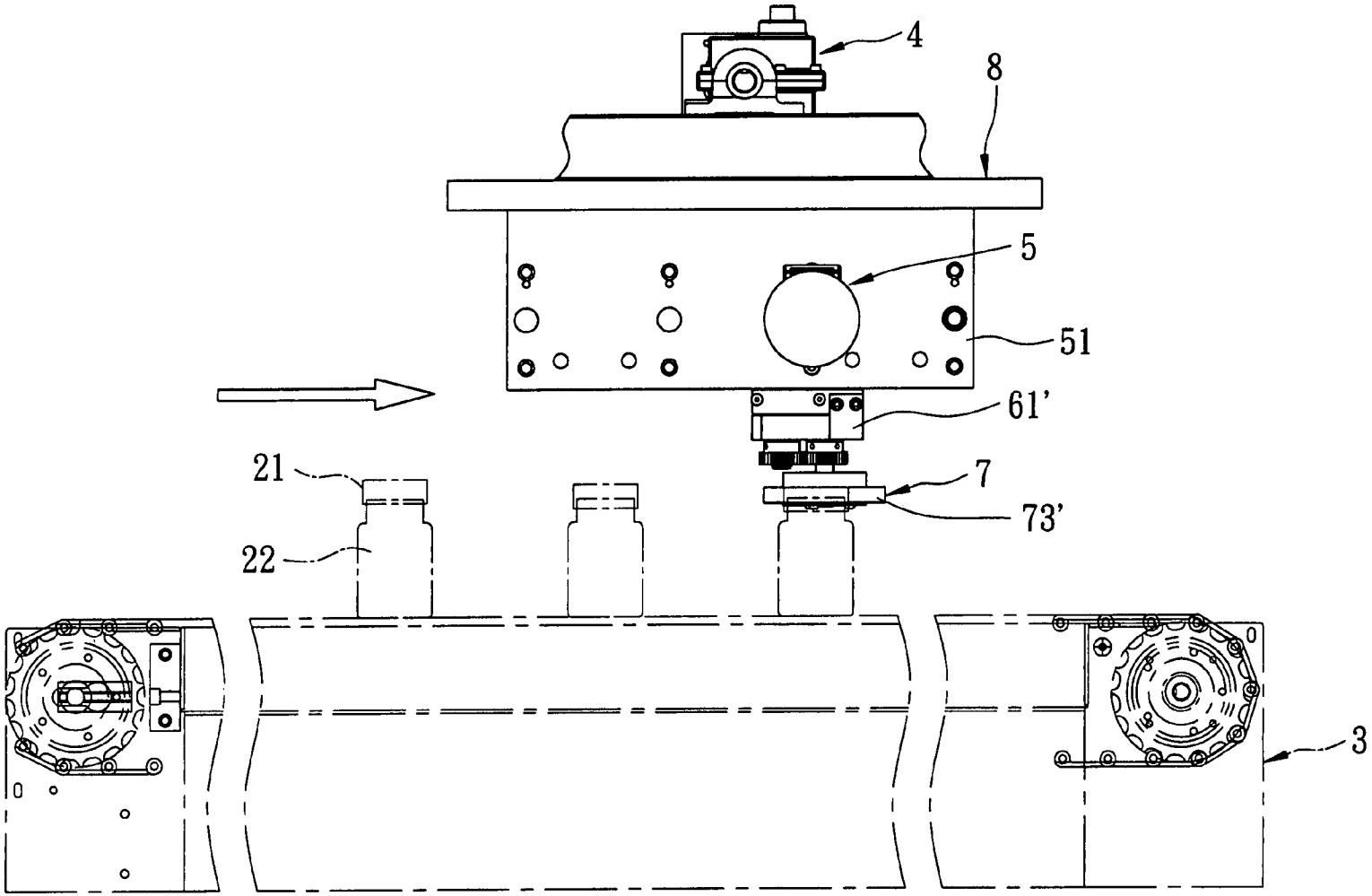
FIG. 2 is a side view of the preferred embodiment of an apparatus for tightening and loosening caps on containers carried on a conveyor.
Figure 3:
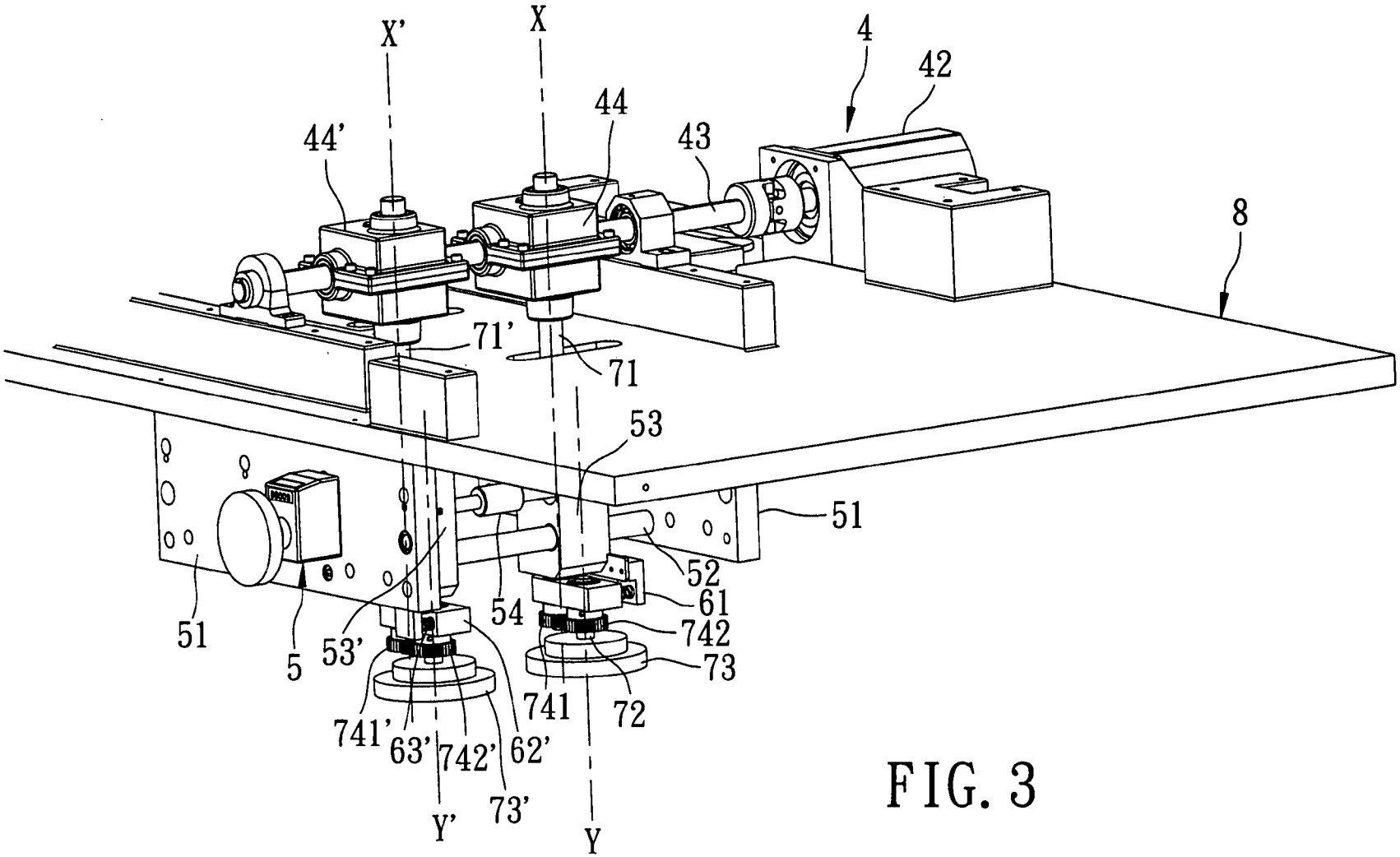
FIG. 3 is a fragmentary perspective view of the embodiment of this invention.
Figure 4:
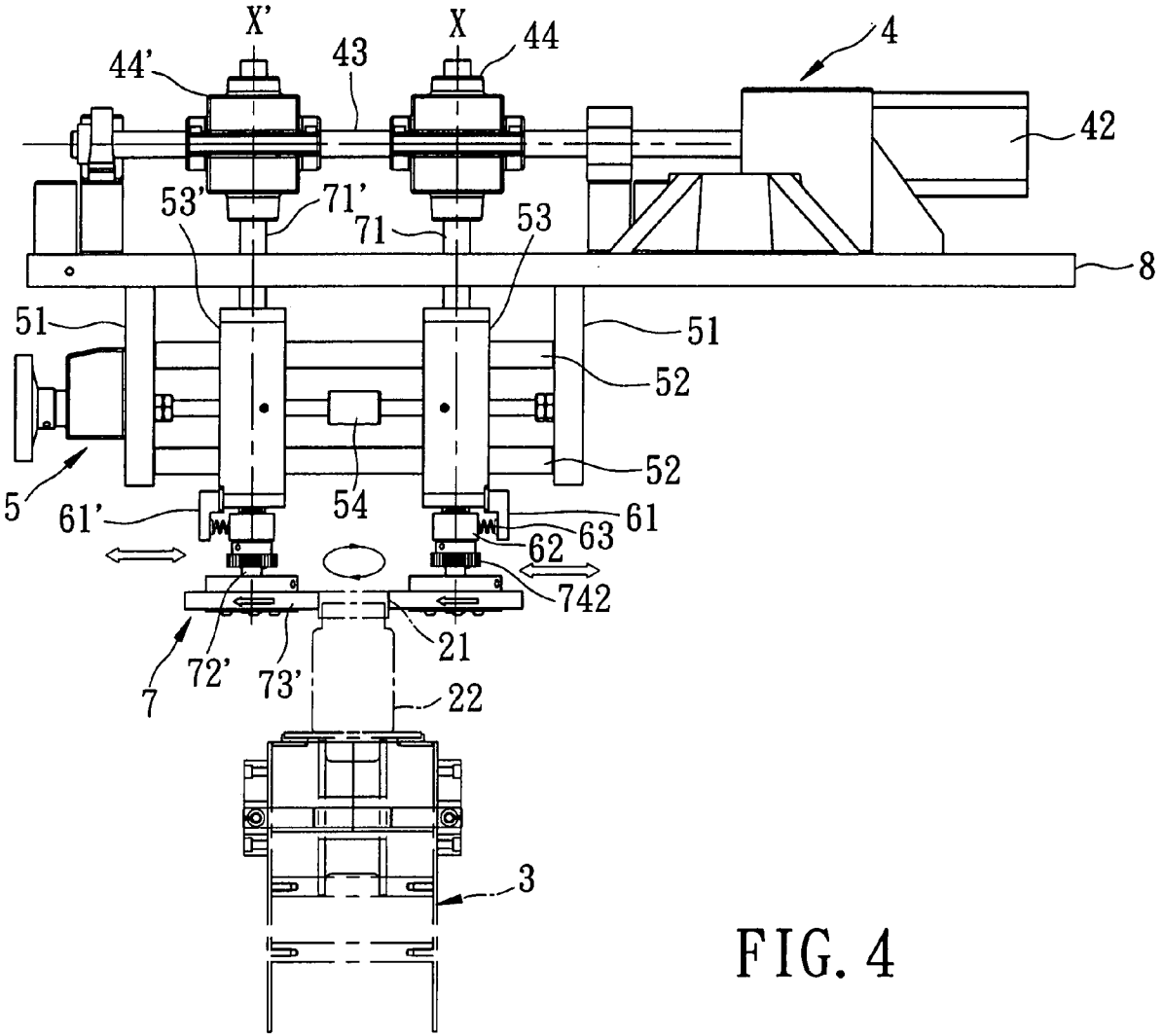
FIG. 4 is another side view of the embodiment of this invention.
Figure 5:
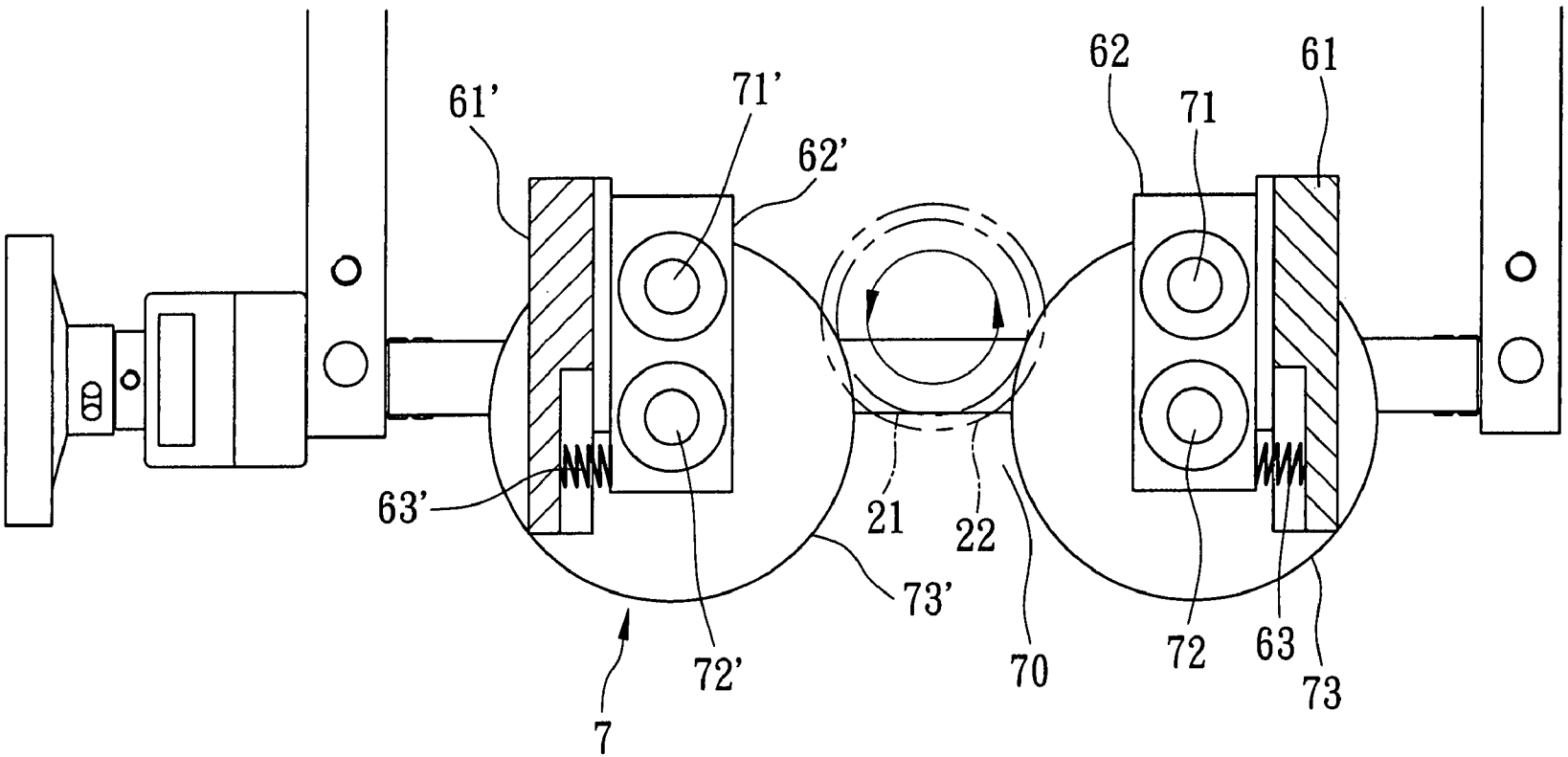
FIG. 5 is a fragmentary, partly sectional view to illustrate how the cap is driven by two rotary members at an entrance of a cap passage defined by the two rotary members of the embodiment.
Figure 6:
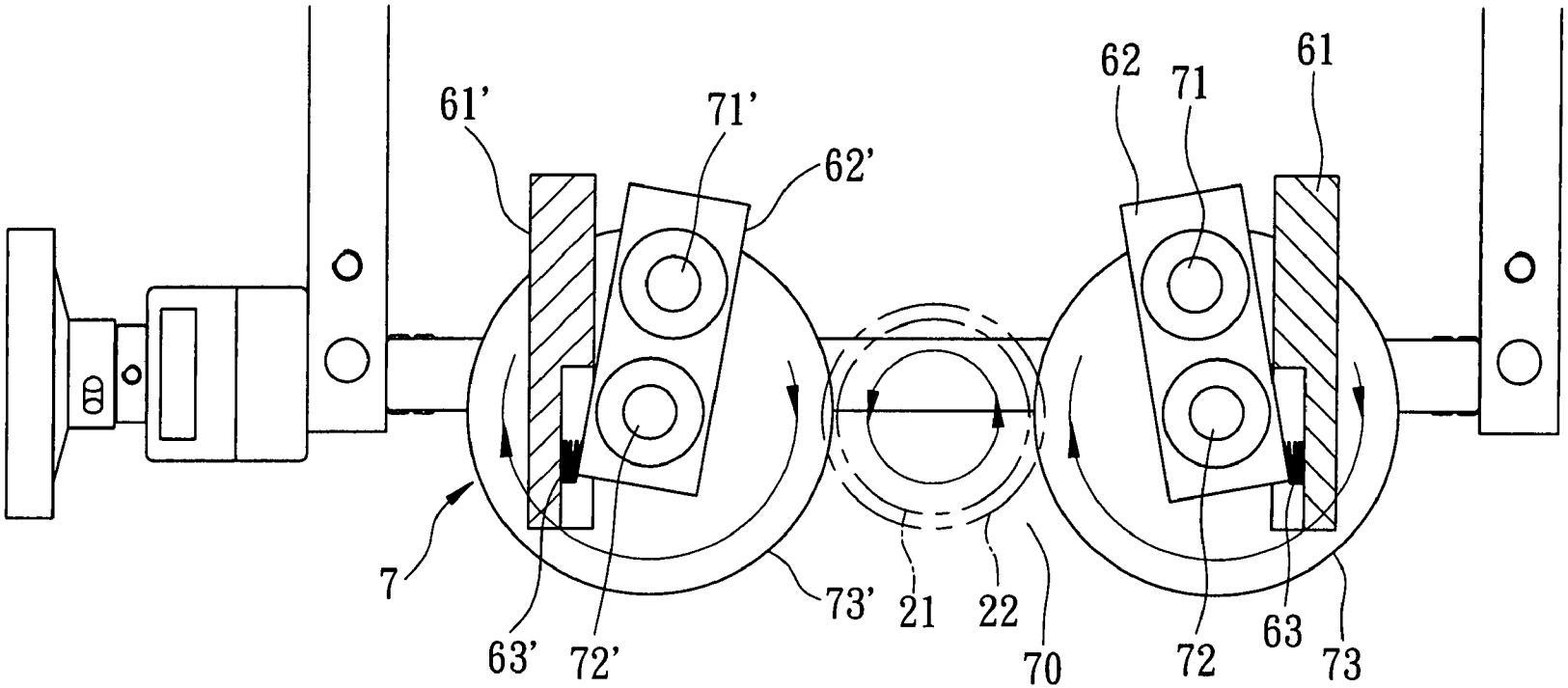
FIG. 6 is a fragmentary, partly sectional view to illustrate how the rotary members pivot about respective axes during passage of the cap through the cap passage.

FIGS. 2 to 6 illustrate the preferred embodiment of an apparatus for tightening and loosening caps 21 on containers 22 that are carried on a conveyor 3 according to the present invention.

The apparatus includes: a support 8; a first rotary member 73 mounted rotatably on the support 8 and rotatable about a first rotation axis (Y); a complementary unit 7 that is mounted on the support 8 and that is complementary to and that cooperates with the first rotary member 73 to define a cap passage 70 therebetween (see FIGS. 5 and 6), the cap passage 70 having a width that is adapted to be configured so as to be slightly smaller than the diameter of the caps in order to permit frictional and sliding contact between the first rotary member 73 and the caps 21 and between the complementary unit 7 and the caps 21; and a driving unit 4 for driving the first rotary member 73 to rotate about the first rotation axis (Y). At least one of the first rotary member 73 and the complementary unit 7 is pivotable relative to the support 8 so as to permit widening of the cap passage 70 when the caps 21 push through the cap passage 70 by virtue of an external force resulting from the transport of the conveyor 3. In this embodiment, the first rotary member 73 is pivotable relative to the support 8 about a first pivot axis (X) that is parallel to the first rotation axis (Y).

A first biasing member 63 is mounted on the support 8 for urging the first rotary member 73 in a direction toward the complementary unit 7 so as to permit continuous frictional contact between the first rotary member 73 and the caps 21 during passage of latter through the cap passage 70.

Preferably, the complementary unit 7 includes a second rotary member 73' that is mounted rotatably on the support 8 and that cooperates with the first rotary member 73 so as to define the cap passage 70 therebetween. The second rotary member 73' is pivotable relative to the support 8 about a second pivot axis (X') that is parallel to the first pivot axis (X) and that is aligned with the first pivot axis (X) in a transverse direction relative to the cap passage 70. The second rotary member 73' is also driven by the driving unit 4, and is rotatable about a second rotation axis (Y') that is parallel to the first rotation axis (Y) and that is aligned with the first rotation axis (Y) in the transverse direction. In this embodiment, each of the first and second rotary members 73, 73' is in the form of a wheel.

A second biasing member 63' is also mounted on the support 8 for urging the second rotary member 73' in a direction toward the first rotary member 73.

Preferably, the apparatus further includes a first shaft 71 that is driven by the driving unit 4 and that defines the first pivot axis (X), a first shaft-mounting seat 62 that is sleeved rotatably on the first shaft 71, a second shaft 72 that is mounted rotatably on the first shaft-mounting seat 62, that defines the first rotation axis (Y), and that is secured to the first rotary member 73, first and second gears 741, 742 that are respectively secured to the first and second shafts 71, 72 and that mesh with each other so as to permit rotation of the first rotary member 73 about the first rotation axis (Y) upon actuation of the driving unit 4, a third shaft 71' that is driven by the driving unit 4 and that defines the second pivot axis (X'), a second shaft-mounting seat 62' that is sleeved rotatably on the third shaft 71', a fourth shaft 72' that is mounted rotatably on the second shaft-mounting seat 62', that defines the second rotation axis (Y'), and that is secured to the second rotary member 73', and third and fourth gears 741', 742' that are respectively secured to the third and fourth shafts 71', 72' and that mesh with each other. The first rotary member 73 is indirectly urged by the first biasing member 63 through the first shaft-mounting seat 62 which abuts against the first biasing member 63. The second rotary member 73' is indirectly urged by the second biasing member 63' through the second shaft-mounting seat 62' which abuts against the second biasing member 63'.

The support 8 includes two opposite lug plates 51, and two guiding rods 52, each of which extends in the transverse direction between the lug plates 51 and each of which is secured to the lug plates 51. The first rotary member 73 and the second rotary member 73' of the complementary unit 7 are aligned in the transverse direction. First and second slides 53, 53' are mounted on and are slidable along the guiding rod 52, and are respectively sleeved on the first and third shafts 71, 71' so as to permit co-sliding movement of the first shaft 71 together with the first shaft-mounting seat 62, the second shaft 72, and the first rotary member 73, and the third shaft 71' together with the second shaft-mounting seat 62', the fourth shaft 72', and the second rotary member 73' in the transverse direction along the guiding rods 52 and so as to permit adjustment of the width of the cap passage 70 in order to suit the diameter of the caps 21.

First and second spring-mounting plates 61, 61' are respectively secured to the first and second slides 53, 53' for holding the first and second biasing members 63, 63', respectively.

The driving unit 4 includes a servo motor 42, a transmission shaft 43 that extends in the transverse direction, that is perpendicular to the first and third shafts 71, 71', and that is directly driven by the servo motor 42, and first and second coupling members 44, 44' that are mounted movably on the transmission shaft 43 and that couple the transmission shaft 43 to the first and third shafts 71, 71' so as to permit rotation of the first and third shafts 71, 71' upon actuation of the servo motor 42. Each of the first and second coupling members 44, 44' is in the form of a miter gear box, and is slidable along the transmission shaft 43 so as to co-slide with the respective one of the first and second slides 53, 53' during adjustment of the relative position between the first and second rotary members 73, 73'.

An adjusting unit 5 includes a screw rod 54 that extends through the first and second slides 53, 53' and the lug plates 51, and that engages threadedly the first and second slides 53, 53' so as to permit adjustment of the relative position between the first and second slides 53, 53', i.e., the relative position between the first and second rotary members 73, 73'.

Figure 7:
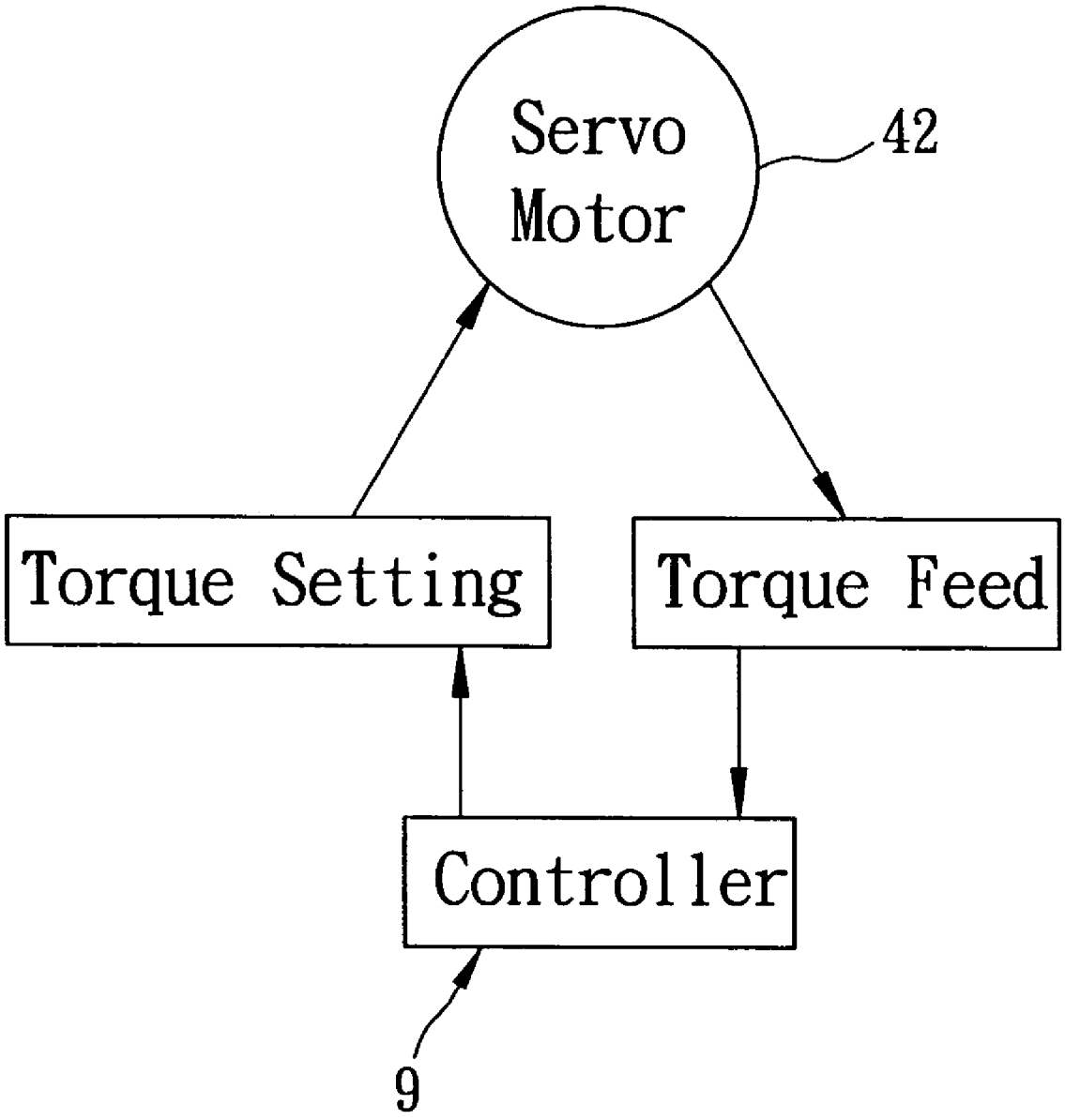
FIG. 7 is a block diagram to illustrate how the amount of torque outputted by a servo motor of the embodiment of this invention is controlled through a controller.

Referring to FIG. 7, a controller 9 is connected electrically to the servo motor 42 for detecting the amount of torque outputted by the servo motor 42 and for setting a predetermined maximum value of torque that can be outputted by the servo motor 42.

With the inclusion of the first rotary member 73 and the complementary unit 7 which preferably includes the second rotary member 73', in the apparatus of this invention, the aforesaid drawbacks associated with the prior art can be eliminated.

With the invention thus explained, it is apparent that various modifications and variations can be made without departing from the spirit of the present invention.

I claim:

1. An apparatus for tightening and loosening a cap on a container, comprising:

a support including a guiding rod;

a first rotary member mounted rotatably on said support and rotatable about a first rotation axis;

a second rotary member that is mounted on said support and that is complementary to and that cooperates with said first rotary member to define a cap passage therebetween, said cap passage having a width that is adapted to be configured so as to be slightly smaller than the diameter of the cap in order to permit frictional and sliding contact between said first rotary member and the cap and between said second rotary member and the cap;

a driving unit for driving said first rotary member to rotate about said first rotation axis;

a biasing member that is mounted on said support for urging said first rotary member in a direction toward said second rotary member;

a first shaft that is driven by a driving unit and that defines said first pivot axis;

a shaft-mounting seat that is sleeved rotatably on said first shaft;

a second shaft that is mounted rotatably on said shaft-mounting seat that defines said first rotation axis, and that is secured to said first rotary member;

first and second gears that are respectively secured to said first and second shafts and that mesh with each other so as to permit rotation of said first rotary member about said first rotation axis upon actuation of said driving unit, said first rotary member being indirectly urged by said biasing member through said shaft-mounting seat which abuts against said biasing member; and a slide mounted on said guiding rod of said support;

wherein said first rotary member is pivotable relative to said support about said first pivot axis that is parallel to said first rotation axis, said second rotary member being pivotable relative to said support about a second pivot axis that is parallel to said first pivot axis and that is aligned with said first pivot axis in a transverse direction relative to said cap passage, said second rotary member being rotatable about a second rotation axis that is parallel to said first rotation axis and that is aligned with said first rotation axis in said transverse direction;

wherein said guiding rod extends in said transverse direction, said first rotary member and said second rotary member being aligned in said transverse direction; and wherein said slide is slidable along said guiding rod and is sleeved on said first shaft so as to permit sliding movement of said first shaft together with said shaft-mounting seat, said second shaft, and said first rotary member in said transverse direction toward and away from said second rotary member.

2. The apparatus of claim 1, wherein said second rotary member is driven by said driving unit.

3. The apparatus of claim 1, wherein each of said first and second rotary members is in the form of a wheel.

4. The apparatus of claim 1, wherein said driving unit includes a servo motor that is connected to said first rotary member.

5. The apparatus of claim 4, wherein said driving unit further includes a transmission shaft that extends in said transverse direction, that is perpendicular to said first shaft, and that is driven by said servo motor, and a coupling member that is mounted on said transmission shaft and that couples said transmission shaft to said first shaft.

6. The apparatus of claim 5, further comprising a controller that is connected electrically to said servo motor for detecting the amount of torque outputted by said servo motor and for setting a predetermined maximum value of torque that can be outputted by said servo motor.

* * * * *